US007451775B1

(12) United States Patent
Werner, III

(10) Patent No.: US 7,451,775 B1
(45) Date of Patent: Nov. 18, 2008

(54) ERGONOMIC SUPPORT STAFF APPARATUS

(76) Inventor: Philip Henry Werner, III, 2707 Gillis Rd., Mount Airy, MD (US) 21771-9192

( * ) Notice: Subject to any disclaimer, the term of this patent is extended or adjusted under 35 U.S.C. 154(b) by 260 days.

(21) Appl. No.: 11/257,023

(22) Filed: Oct. 25, 2005

Related U.S. Application Data

(63) Continuation-in-part of application No. 11/159,246, filed on Jun. 23, 2005, now Pat. No. 7,222,633.

(51) Int. Cl.
*A45B 1/00* (2006.01)

(52) U.S. Cl. ..... 135/65

(58) Field of Classification Search ..... 135/120.1, 135/120.2, 120.3, 131, 65, 66, 72, 76, 78, 135/82, 86, 77
See application file for complete search history.

(56) References Cited

U.S. PATENT DOCUMENTS 2,192,040 A * 2/1940 Harris ..... 135/77
2,642,884 A * 6/1953 Henderson et al. ..... 135/65
3,635,233 A * 1/1972 Robertson ..... 135/71
5,924,434 A * 7/1999 Cato, III ..... 135/68
5,975,602 A * 11/1999 Zan ..... 294/54.5
6,539,965 B1 * 4/2003 White, III ..... 135/66
6,820,628 B2 * 11/2004 Larson ..... 135/66
2005/0076940 A1 * 4/2005 Larson et al. ..... 135/68

* cited by examiner

*Primary Examiner*—David R Dunn
*Assistant Examiner*—Noah Chandler Hawk
(74) *Attorney, Agent, or Firm*—Rosenberg, Klein & Lee

(57) ABSTRACT

An ergonomic support staff apparatus for supporting a user upon a surface is provided. The apparatus generally includes a longitudinally extended support member. The apparatus also includes a grip handle member adjustably coupled in position along the support member. The grip handle member includes a grip portion which protrudes laterally outward from the support member to extend in inclined manner relative to the support member. Use of the resulting apparatus enables the range of requisite arm swing motion for manipulation of the support member into stable engagement of the given surface to be minimized.

20 Claims, 6 Drawing Sheets

ERGONOMIC SUPPORT STAFF APPARATUS

RELATED APPLICATION DATA

This application is a Continuation-in-part of application Ser. No. 11/159,246 filed 23 Jun. 2005, now U.S. Pat. No. 7,222,633.

BACKGROUND OF THE INVENTION

Field of the Invention

The present invention is directed to an apparatus for supportively assisting a user to maintain balance and stability while engaged in various activities. The apparatus facilitates the natural bodily motions of a user while performing the necessary movements, for example, in walking and in generating propulsion during skiing. Incorporating the ergonomics of natural body movement, the apparatus allows for extended use with less fatigue.

The present invention finds numerous applications. In one exemplary application, the apparatus may form an emergency crutch, which allows for easier movement over rugged terrain. Other applications include a walking stick device, a cane for orthopedic recreational use, and an adjustable handle for ski poles. The invention incorporates an improved gripping system for all of these illustratively noted applications.

Walking sticks, trekking poles, and canes are and have been used from virtually the beginning of time. The subject support staff apparatus does what man has attempted to accomplish since then. The apparatus provides for optimal functional assistance to the natural movements of the body when walking, whether in a natural or impaired condition. Holding one or more of these devices, the user is able to steady the walking function and relieve the stress/impact on the foot/feet.

Ski poles are a part of ski equipment used in both competition and recreation to maneuver during downhill and cross country skiing. The purpose of the pole is to provide balance, aid in turning and braking maneuvers, and to enable propulsive action by the user. Using in each hand a pole formed in accordance with the present invention, the user will experience increased maneuverability with the enhanced ergonomic effect provided at least in part by the reverse grip of the handle.

SUMMARY OF THE INVENTION

An object of the present invention is to provide a support apparatus which may be utilized in various applications as a walking stick, cane, crutch, ski pole and the like.

It is another object of the present invention to provide a support apparatus which incorporates a grip that takes advantage of the natural posture of the user's hand and arm in an ergonomic movement relationship, to require less effort and strain on the upper body during use.

These and other objects are attained in an ergonomic support staff apparatus formed in accordance with the present invention for supporting a user upon a surface. The apparatus generally includes a longitudinally extended support member having upper and lower portions, and an intermediate shaft portion extending therebetween. The apparatus also includes a handle member coupled to at least one of the upper and intermediate shaft portions of the support member. The handle member protrudes laterally outward from the support member to define an angled grip portion disposed to extend in inclined manner relative to the support member. Use of the apparatus thereby enables the range of requisite arm swing motion for manipulation of the support member into stable engagement of the given surface to be minimized.

In certain exemplary embodiments of the present invention, the ergonomic support staff apparatus includes the handle member integrally formed with said support member. In other exemplary embodiments, the apparatus is formed with handle member adjustably coupled to the support member.

In still other exemplary embodiments, the ergonomic support staff apparatus for supporting a user upon a surface comprises: a longitudinally extended support member, a grip handle member adjustably coupled to the support member, and a plurality of fastener members releasably locking the grip handle member to the support member. The support member includes a plurality of positioning holes formed transversely therein. The grip handle member is adjustably coupled to the support member, and includes a main body portion and an angled grip portion protruding laterally outward therefrom. The main body portion coaxially ensleeves a portion of the support member, and is formed with a plurality of access openings directed transversely therethrough for selective alignment with respective ones of the support member positioning holes. The angled grip portion extends in inclined manner relative to the support member. The fastener members then engage aligned pairs of access openings and positioning holes. The resulting apparatus minimizes the range of requisite arm swing motion for manipulation of the support member into stable engagement of the surface.

BRIEF DESCRIPTION OF THE DRAWINGS

In the following description, given by way of example, reference is made to the appended drawings, wherein.

DETAILED DESCRIPTION OF THE PREFERRED EMBODIMENTS

Typical applications of the present invention relate to an orthopedic recreational walking-stick, crutch-cane for emergency use, and an adjustable handle application for ski poles.

In typical walking stick applications of the present invention, a walking stick may be advantageously provided in which both the user's heel and the walking stick base preferably make contact simultaneously with the walk surface, allowing for reduced impact on the user's foot. The handle forms an ergonomic structure which allows for the natural (arc) pivoting of the arm from the shoulder during use, while the user applies a pulling force to the grip of the walking stick. As the present invention provides for various recreational and orthopedic uses, a foot wounded, leg wounded, or handicapped person may be enabled to ambulate substantially as usual with one such walking stick, and to remain more easily in a standing position by keeping his or her balance, while still having in such a position free use of an upper limb.

In certain embodiments particularly well-suited for orthopedic uses, an apparatus formed in accordance with the present invention may assist an injured or handicapped person to move more effortlessly about, serving as a crutch or cane. In other embodiments, the apparatus may preferably be adapted for particular use by adjustably reversing the direction of an auxiliary handle attachment. By redirecting the position of the cane handle attachment, the cane is effectively turned into a two handed cane for use when rising from a sitting position to a standing position. In a walking configuration, the cane provides two handed steadiness by permitting the use of two handles substantially at one junction for grasping.

In still other embodiments, the apparatus may be formed as a ski pole, with the handle serving as an ergonomic device which allows for natural (arc) pivoting of the arm from the shoulder when the user applies a pulling force to the grip of the pole.

Figure 1A:
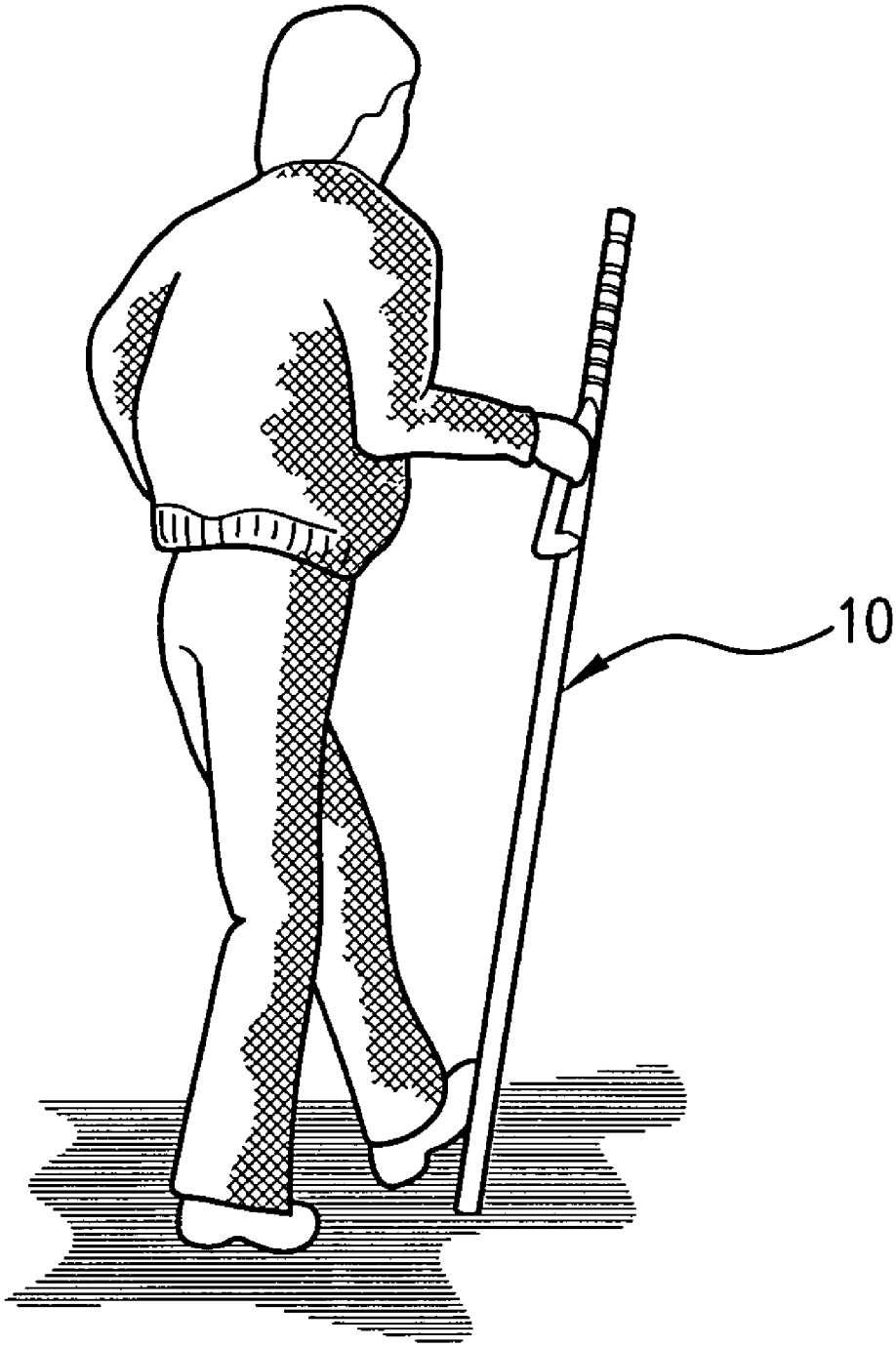
FIG. 1*a* is a schematic perspective view illustrating a typical use of one exemplary embodiment of the present invention.
Figure 1B:
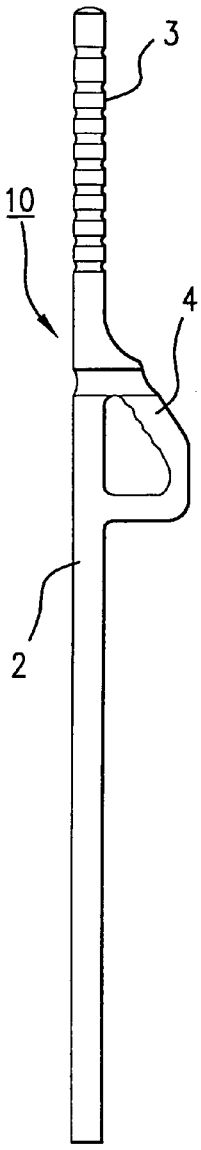
FIG. 1*b* is a side elevational view of the exemplary embodiment of the present invention shown in FIG. 1*a;*
Figure 1C:
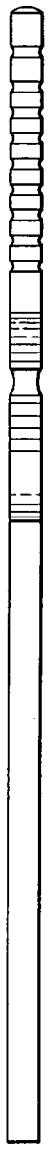
FIG. 1*c* is a rear elevational view of the exemplary embodiment of the present invention shown in FIG. 1*a;*

Referring now to FIGS. 1*a*-1*c*, there is illustratively shown one exemplary embodiment of the present invention suitable for use as an orthopedic walking stick, crutch, or cane. In this embodiment, the staff-like apparatus is integrally formed, with a support member 2 having an elongate intermediate shaft extending between upper and lower ends. A grooved or otherwise surface-roughened handle 3 is preferably formed at the upper end, and a grip handle member 4 is positioned at the intermediate shaft portion.

The entire grip and pole may be constructed from a variety of materials currently known in the art and used in the construction of recreation equipment. Due to the use of various construction materials in the various applications illustratively described herein as well as in additional applications, those skilled in the art will recognize that certain particular features of given embodiments may suitably vary, without departing substantially from the functionality as defined herein.

Figure 2:
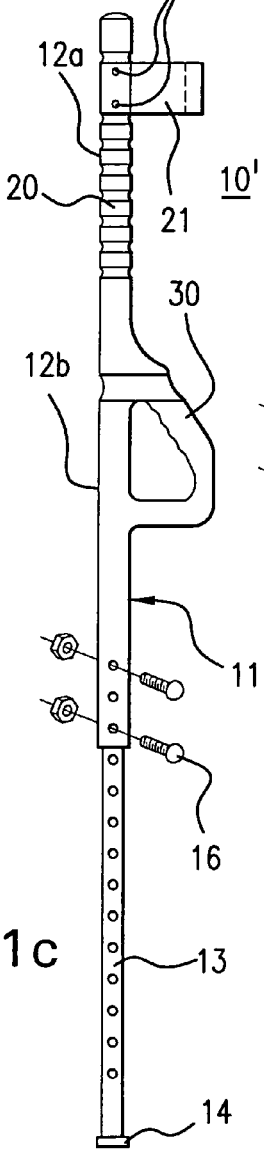
FIG. 2 is a partially exploded side elevational view of an alternate embodiment of the present invention.

Referring to FIG. 2, there is shown an alternate embodiment of the present invention which is similar to that illustrated in FIGS. 1*a*-1*c*, but is adjustably configured to serve as an orthopedic walking-stick particularly well-suited for emergency use. The stick 10' in this embodiment comprises a standard or body 11 formed collectively by a combination of a handle section 12*a* extending from a tube 12*b* to which is telescopically coupled an end section 13 fitted with a rubber foot 14. Preferably, the length of the standard, or support member body 11, may be adjustably locked in the desired configuration by means of one or more knurled knobs (not shown) or bolts 16 fitting into pre-drilled holes.

The upper part of the walking stick handle 20 in this embodiment is provided with a crutch extension part 21 which, having a lined or unlined retainer for the support of the forearm, is attached by clamping screws 22 secured thereto, or by any other suitable means known in the art. This crutch extension feature is configured and situated such that it may be easily discarded from use by the user simply folding his or her lower arm inward, should he/she become unstable. That is, the crutch extension part 21 naturally releases and falls away from the user's arm responsive to the lower end of the support member body 11 swinging upward with the user's hand (gripping the grip handle member), thereby freeing the user's arm from unwanted restraint.

The main grip handle section 30 may advantageously function as a part of the walking stick, cane, or the like formed by the apparatus 10'. The grip portion of this section 30 is preferably inclined at an angle ranging substantially between 33 and 45 degrees from vertical.

Figure 3:
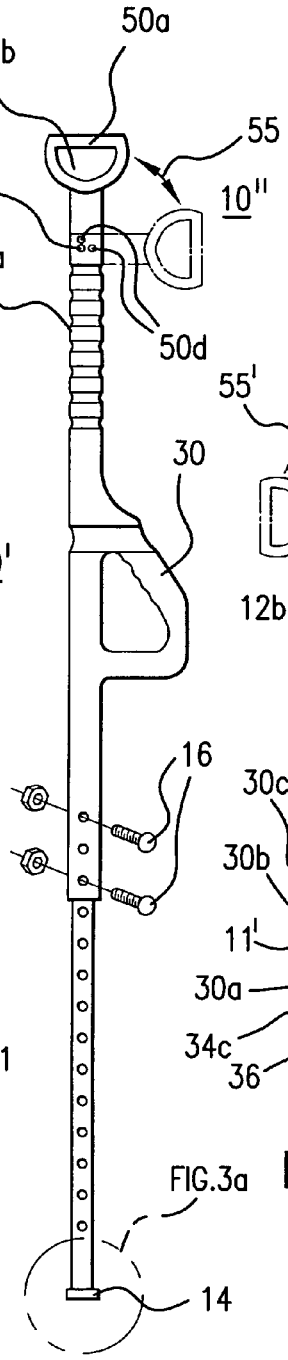
FIG. 3 is a partially exploded side elevational view of another alternate embodiment of the present invention.

FIG. 3 illustrates another alternate embodiment of the present invention. This embodiment is a similar to the two preceding embodiments particularly suitable for cane/walking stick applications. In this embodiment, an upper portion of the apparatus 10" is provided with a shaft fitting into the main body above the staff handle, with a grooved shovel style handle extension 50*a* coupled to terminate the staff handle section 12*a*. Between the coupling or attachment point and end of the shovel style handle 50*a* there is defined a grooved section 50*b* for firm, secure gripping. This section of the handle may be moved from side to side, as indicated by the direction arrow 55, by the means of a pinned hinge 50*c* and a tightening lug or knob 50*d*.

Preferably, the shovel style handle 50*a* may also be moved about the axis of the staff handle section 12*a*, by 360 degrees for example, to facilitate two handed grasping at any angle combination. Such turning of the shovel style handle may be facilitated by means of any suitable tightening knob (not shown). This allows for quick adjustment into various positions for two handed control and stability when walking, and/or when rising from or lowering into a sitting position.

Figure 3A:
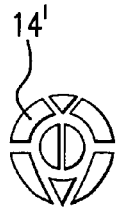
FIG. 3*a* is a detailed bottom plan view of a portion of the exemplary embodiment shown in FIG. 3, illustrating an exemplary tread pattern for a base tip.

FIG. 3*a* illustrates in greater detail an example of numerous tread patterns that may be suitably formed at the bottom of the gripping tip 14. In the example shown, the tread surface defines a direction indicating gripping tip 14' which not only serves to enhance traction, but also tends to leave an arrow-like directional imprint on the underlying surface. This may prove helpful should the need arise to later track the user's path of travel.

Figure 4:
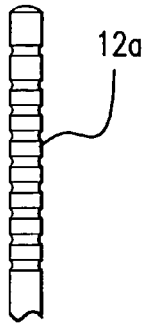
FIG. 4 is a cut away isolated side elevational view of an upper portion of a support member in the exemplary embodiment shown in FIG. 1*b;*
Figure 4A:
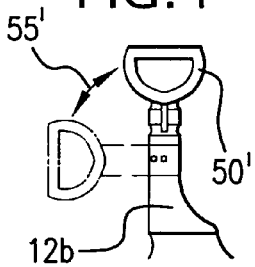
FIG. 4*a* is a cut away isolated side elevational view of a portion of another alternate embodiment of the present invention.
Figure 4B:
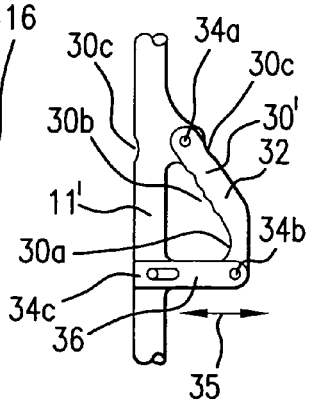
FIG. 4*b* is a cut away isolated side elevational view of a portion of a handle member in still another alternate embodiment of the present invention.

Turning to FIGS. 4-4*b*, there are shown examples of various structural configurations which may be employed in accordance with still other alternate embodiments of the present invention. In FIG. 4, an isolated view of the upper or staff handle 12*a* having a ribbed configuration of the type employed in the embodiment of FIGS. 1*a*-1*c* is shown. In FIG. 4*a*, a shovel style handle 50' much like that illustrated in the embodiment of FIG. 3 is shown coupled directly to an intermediate portion 12*b* of the given staff or support member. As in the embodiment of FIG. 3, this shovel style handle 50' is preferably coupled for pivotal displacement as indicated, for example, by the directional arrow 55'.

In FIG. 4*b*, the main grip handle member 30' is shown in an exemplary adjustable configuration. Preferably, the inclined handle portion 32 of the grip member 30' is pivotally coupled by a pin 34*a* at its juncture with the staff member 11'. The handle portion 32 is preferably also pivotally coupled by a pin 34*b* to a lateral portion 36 which is in turn slotted pin coupled to the staff member 11' (as shown at 34*c*) to form a pinned hinged slide coupling therewith. This enables slidable adjustment, as indicated by the directional arrow 35, to accommodate the handle portion's angular adjustment. Once adjusted to the desired position, the coupling is preferably secured by means of one or more counter sunk bolts, pins, or clamping brackets of any suitable type known in the art.

Preferably, the handle portion 32 is formed with one large finger groove 30*a* and four normal finger grooves 30*b*. At the juncture of the grip member 30 and the vertical stick, or staff member 11', two wide shallow grooves 30*c* are preferably formed for placement of the forefinger and thumb as an alternative grasping position.

Each of the preceding embodiments shown preferably include such grooving to extends endlessly around the juncture of the intermediate and upper handle portions of the support or staff member. This grooving allows comfortable fit between thumb and forefinger. The handle may have any additional grooves formed therein to suitably accommodate the user.

Figure 5A:
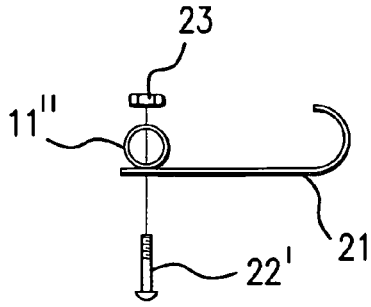
FIG. 5*a* is a partially exploded top plan view of the portion of the exemplary embodiment shown in FIG. 5.
Figure 5:
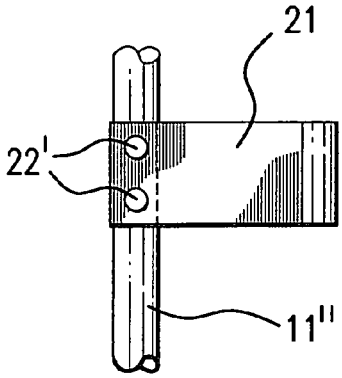
FIG. 5 is a cut away isolated side elevational view illustrating a portion of an additional alternate embodiment of the present invention.

FIGS. 5 and 5*a* illustrate the arm cradling part 21 of the crutch embodiment, such as shown in FIG. 2, being attached to any suitable portion of the given staff member 11". The part 21 is attached in this embodiment by clamping bolts 22' secured by corresponding nuts 23.

Figure 6:
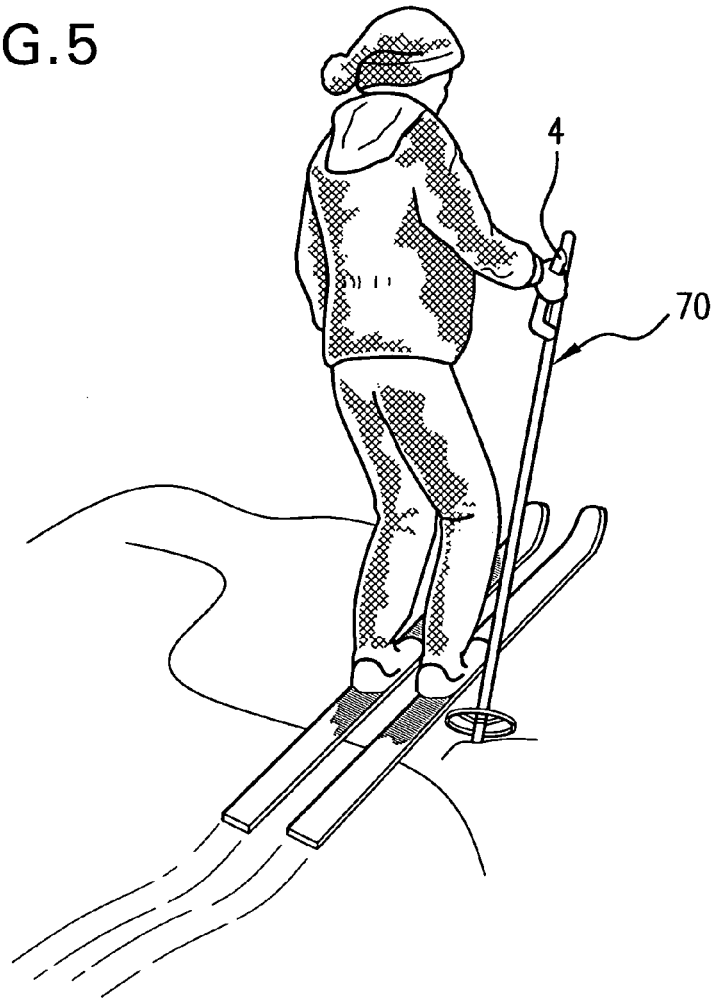
FIG. 6 is a schematic perspective view illustrating a typical use of yet another alternate embodiment of the present invention.

In FIG. 6, there is illustratively shown an alternate embodiment of the present invention suitable for use as an orthopedic ski pole. In this embodiment, a grip handle member 4 is formed much as described in preceding paragraphs onto a support member configured as a ski pole terminated at its bottom by a pointed ski pole tip. This embodiment allows for the described ergonomic-grip-pulling motion, with each arm moving in a natural arc, to ease the user's self-propelling and maneuvering actions during skiing.

Briefly, use of the subject apparatus as a walking stick, a cane, or a ski pole, for example, advantageously allows for a natural movement of the user's arm, which in turn allows for a natural pulling movement from the wrist. Such use puts less stress on the user's arm than comparable devices heretofore known in the art. As a walking stick or crutch, the apparatus among other things aids in reducing impact upon an injured foot when walking, allowing the user's arm to absorb some of the weight of impact. This may be accomplished by allowing the walking stick/cane to impact the walking surface at the same time the foot strikes the walking surface.

The walking stick/cane embodiment also allows for several emergency field uses with the addition of attachments. These attachments, for instance, allow the user to convert the walking stick into an emergency crutch to assist in walking with a disabled foot or leg.

When implemented in ski poles, the subject apparatus allows for primarily a pulling motion of the arm instead of a pushing motion. Use of the angled grip handle allows for greater force to be applied to the poles in this manner for propulsion, as it effectively increases the leverage and resulting force that may be applied to the snow surface underneath.

An overall effect of the force applied by use of the subject apparatus, for propulsion and for shock reduction, is more efficient use of natural body leverage. The apparatus takes fuller advantage of the user's upper body strength and natural swing movement of the entire arm. Another effect is to reduce the required stress on lower arms and wrists, by taking advantage of the natural movement and alignment of the arm.

Additional components and features of the walking stick/cane and ski pole not explicitly described in the Detailed Description may be included to enhance performance or flexibility of use.

Figure 7:
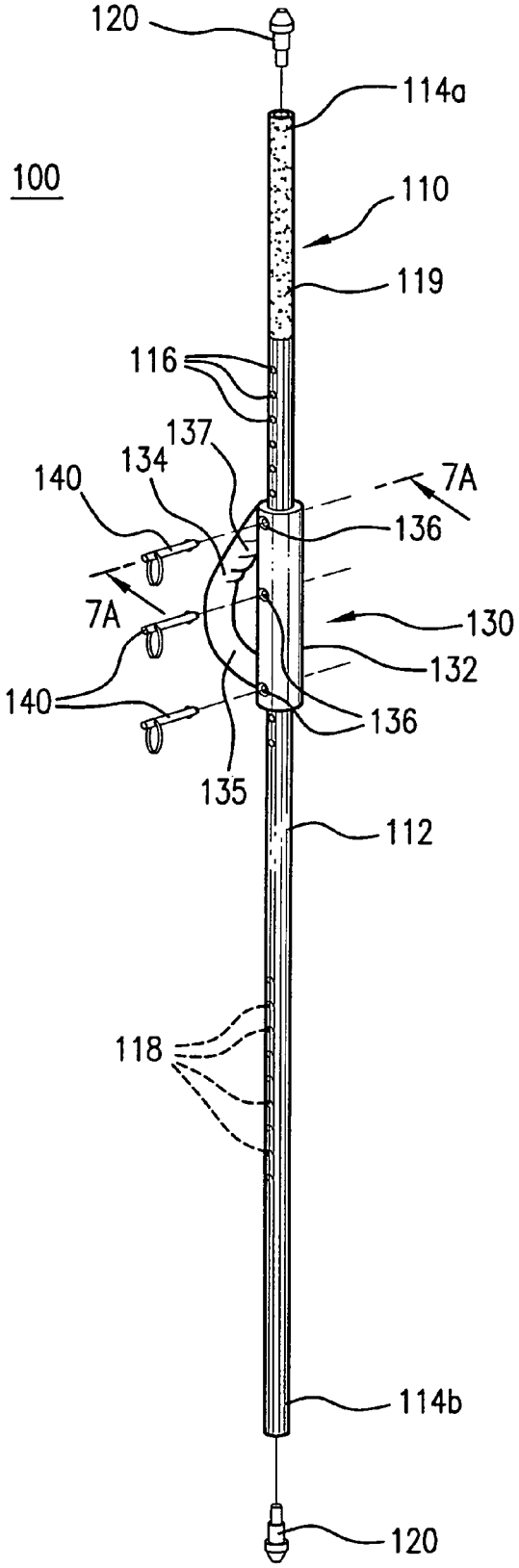
FIG. 7 is a partially exploded perspective view illustrating yet another alternate embodiment of the present invention.
Figure 7A:
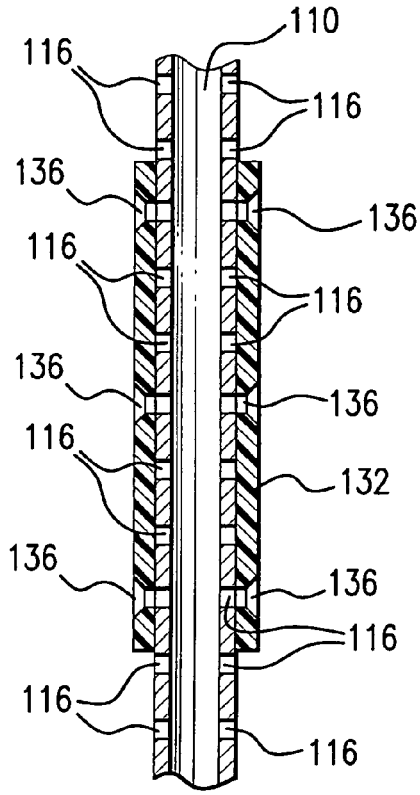
FIG. 7*a* is a sectional view, partially cut away, illustrating a portion of the alternate embodiment shown in FIG. 7.
Figure 8:
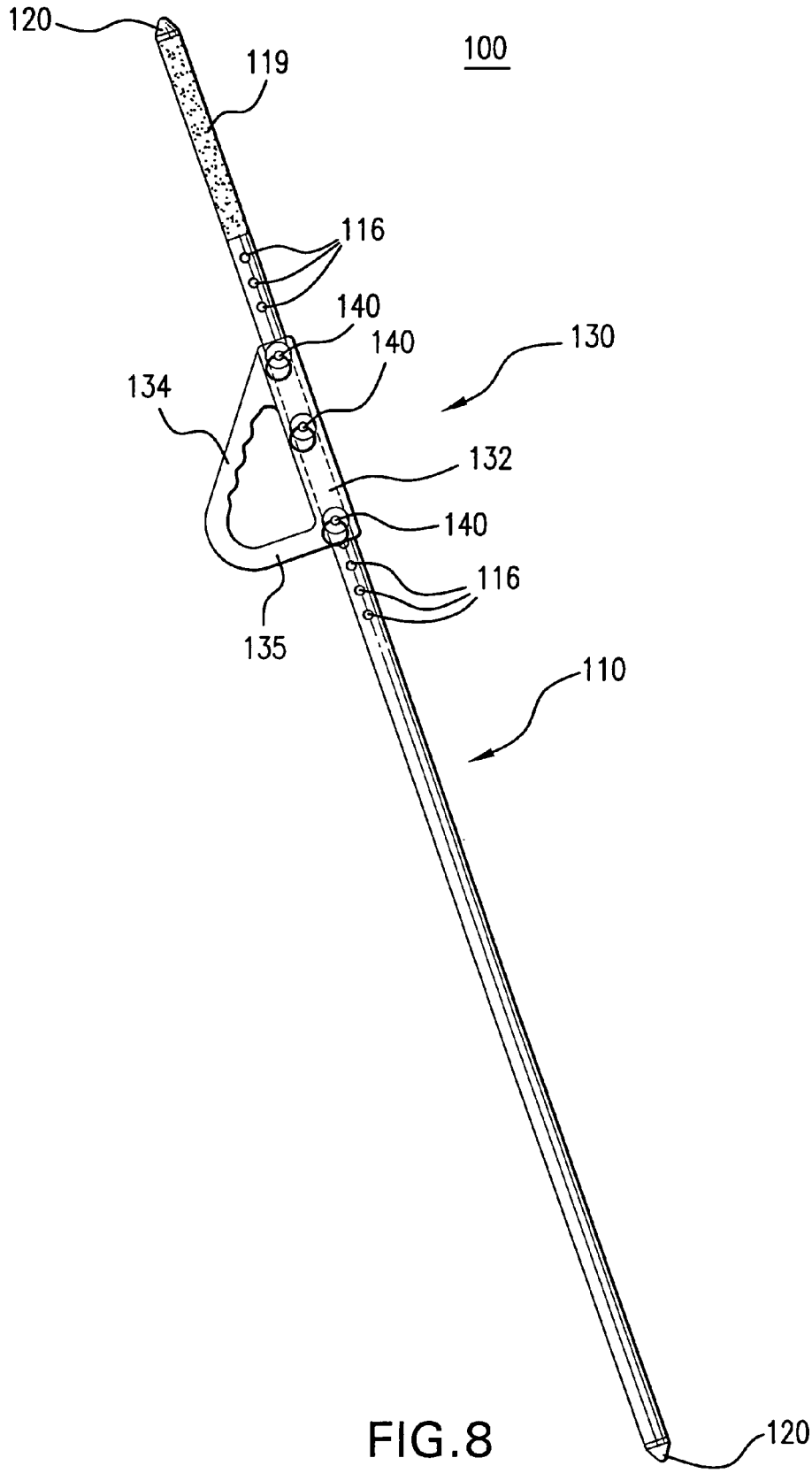
FIG. 8 is a side elevational view illustrating the alternate embodiment shown in FIG. 7, fully assembled.

Referring next to FIGS. 7, 7*a*, and 8, there is illustrated yet another exemplary embodiment of the present invention. The apparatus in this embodiment is formed as a highly adaptable ergonomic walking stick 100 having an elongated staff-like support member 110 to which a grip handle member 130 is coupled in adjustably positioned manner. The resulting assembly permits simple and convenient re-configuration to 'custom fit' the height, arm length, and other bodily dimensions of the given user for a particular application without unduly sacrificing the integrity, strength, and stability of structure.

As shown, the support member 110 is formed with a plurality of transverse positioning holes 116 spaced one from the other. Preferably, these positioning holes 116 are each formed as through holes leading transversely through the support member 110. They are formed much as a transverse bore where the support member 110 is of solid construction, or as aligned pairs of through openings 116 disposed in transversely opposing wall surfaces where the support member 110 is formed with a hollow construction.

The support member 110 includes upper and lower end portions 114*a*, 114*b* between which an intermediate shaft portion 112 longitudinally extends. The positioning holes 116 are preferably arranged at certain points along the intermediate shaft portion 112, the set of holes 116 being preferably disposed more towards the upper end portion 114*a* than the lower end portion 114*b*. Such positioning holes 116 provide the selective anchoring/fastening points for the adjustable grip handle member 130.

In the embodiment shown, the upper and lower end portions 114*a*, 114*b* of the support member 110 each form a substantially tubular outlet which defines an axial opening to be engaged by a tip member 120*a*, 120*b* described in following paragraphs. Depending on the properties of the material employed and the specific requirements of the intended application, the intermediate shaft portion 112 may likewise be formed with a hollow, substantially tubular structure, or with an otherwise solid structure.

In most applications, overall apparatus weight is a limiting factor. Hence, the degree of strength, rigidity, and other such structural properties must be adequately balanced with the overall weight afforded for apparatus 100 by the intended application. Such balancing of properties will depend largely upon the choice of material for the support member 110, which in accordance with the present invention, may be of any suitable type known in the art—such as metal, plastic, wood, composite, or the like—permitted by the requirements of the intended application. The wide range of possible materials includes bamboo, fiberglass, graphite, steel, and aluminum, for example.

While the support member 110 is shown with a straight cylindrical contour, it may be formed in other embodiments with various other contours particularly suited for the intended use. For trekking or ski pole applications, for instance, the support member 110 may be formed with a tapered, or an even more dramatically bent arcuate contour.

Similarly, suitable sectional contours other than the generally circular sectional contour shown may be employed to better suit the intended application.

The grip handle member 130 is formed with a main body portion 132 which effectively ensleeves a portion of the support member 110. The grip handle member 130 is also formed with an angled grip portion 134 that extends laterally outward from the main body portion 132 in a downwardly inclined manner, as illustrated. This angled grip portion 134 is preferably supported at its bottom end by an arm portion 135 which extends back to the main body portion 132 to complete a strong and secure gripping handle loop.

As in preceding embodiments, the angled grip portion 134 is inclined downward at an angular offset from the support member 110 by a relative angle substantially within the approximate range of approximately 33°-45°. A plurality of finger grooves 137 are preferably formed on the angled grip portion 34 to enable a surer, secure grip by the user. Other suitable measures known in the art, such as a series of finer slot-like grooves, certain roughened surfaces, a tacky coating, among others, may be likewise employed in the alternative.

The main body portion 132 is formed with an axial bore which closely conforms in contour to that portion of the support member along which the portion may be positioned during use. The dimensional relationship between the main body portion axial bore and the given portion of the support member 110 is preferably such that the main body portion 132 snugly ensleeves the support member portion, yet is slidably displaceable relative thereto. This allows for a suitable degree of frictional coupling between the conforming surfaces to aid the stable retention of the main body portion 132 about the support member 110 without unduly restricting its positional adjustability along the appropriate support member portion. That is, a tightly conformed yet readily slidable coupling is preferably realized.

The main body portion 132 is formed with a plurality of access openings 136 directed transversely therethrough. Given the generally sleeve-like tubular configuration of the main body portion 132 about the support member 110 in the embodiment shown, correspondingly aligned pairs of such access openings 136 are formed in transversely opposed wall surfaces of the main body portion 132. Corresponding openings 136 then cooperatively receive a fastener member 140. As more clearly illustrated in the sectional view of FIG. 7*a*, the grip handle member 130 may be positioned for fastening to the support member 110 by aligning these access openings 136 with a selected combination of the support member's positioning holes 116. A fastener member 140 may be passed, thereafter, transversely through each aligned group of access openings 136 and positioning holes 116 to lock the grip handle member 130 in its selected position along the support member 110.

In certain applications, the locking effect provided by one such fastener member 140 may be sufficient. To reinforce this locking effect, it is preferable to employ a plurality of such fastener members 140 to pass through a plurality of longitudinally offset groups of such aligned access openings 136 and positioning holes 116, as illustrated.

The fastener members 140 may be of any suitable type known in the art. In the embodiment shown, each fastener member 140 is of a metallic pin-type, preferably having a resiliently biased retention element at some point therealong. The retention element is realized in the embodiment shown, for example, in a bearing which is spring loaded to protrude radially outward from the pin near its leading end. In its protruded state, the bearing catches against a surrounding wall surface, the given fastener member 140 having emerged from an access opening 136 or a positioning hole 116. Depending on the actual point along a given pin 140 at which such bearing is positioned, this surrounding wall surface may be of the grip handle member's main body portion 132, or of the support member 110 itself. The catching engagement stops the pin member's withdrawal from its locking engagement unless a force sufficient to overcome the bearing's bias force and cause its retraction is applied to withdraw the pin member through the access openings 136 and positioning holes 116.

The grip handle member 130 may then be adjusted in position along the support member 110 by selectively fastening to a first set of spaced positioning holes 116. In alternate embodiments, an additional set of positioning holes 118 may be provided more towards the lower end 114*b* of the support member 110 to facilitate the support member's use in an inverted orientation. Apparatus 100 may be readily converted to this inverted orientation by simply unfastening the grip handle member 130 and sliding it free of the support member 110, off one of the upper or lower ends 114*a*, 114*b*. The grip handle member 130 may likewise be inverted relative to the support member 110 and re-engaged therewith from either of the ends 114*a*, 114*b*. With the support member 110 thus inverted, the reoriented grip handle member 130 may be fastened to selected ones of the second set of positioning holes 118.

Such inversion of the support member 110 may be desirable or necessary for numerous possible reasons. For example, the particular shape and configuration of the support member 110 may be such that is better suited for a given application when inverted (although this may not be applicable with the straight cylindrical support member contour shown in the disclosed embodiment). The position and arrangement of the second set of positioning holes 118 may be such that inversion affords additional positioning variations for the grip handle member 130 relative to the support member 110. Another reason may simply be that the terminal tip formed at one end 114*a* is more suitable for the given application than a tip formed at the other end 114*b*—perhaps for such reasons as it differs in structural configuration and/or material properties from the other; or, it simply is less worn than the other.

There may be instances during use of the apparatus 100 where the user must grip the support member 110 directly to maintain stability. Suitable measures may be taken to make all or certain portions of the support member 110 more 'grip-friendly' than it might otherwise be. In the embodiment shown, the gripping surfaces offered by the grip handle member 130 are supplemented by an auxiliary grip provided at an upper part of the support member 110. This may be realized in various forms, such as by providing at the given support member part a coating or other such ensleeving layer 119 of a suitable tack enhancing material known in the art. Alternatively, the surface of the support member 110 at such part may be ribbed, roughened, or otherwise textured/contoured mechanically to enable a sure grip.

The apparatus 100 preferably includes at least one substantially conical tip member 120 detachably coupled to at least the lower end 114*b* of the support member 110. In the exemplary embodiment shown, an additional tip member 120 is also detachably coupled to the upper end 114*a* of the support member 110. Each tip member 120 is coupled to the respective ends 114*a*, 114*b* preferably by frictional insert into the substantially tubular openings they define.

Figure 9:
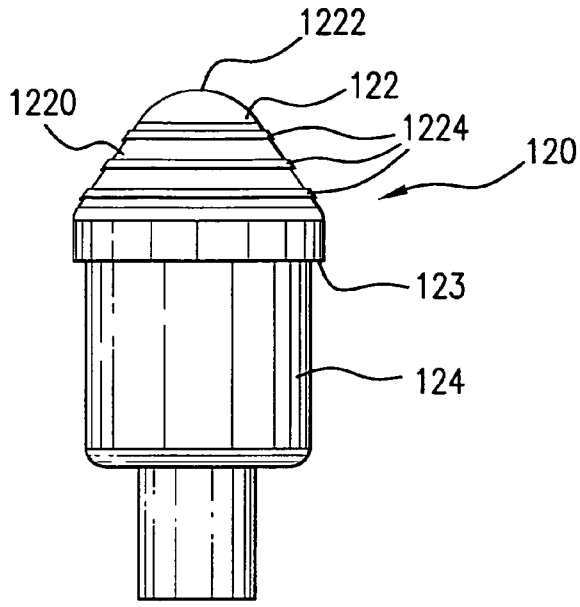
FIG. 9 is a detailed elevational view of a portion of the alternate embodiment shown in FIG. 7; and, FIG. 10 is a partially exploded and partially cut away perspective view illustrating a portion of still another alternate embodiment of the present invention.

Referring to FIG. 9, each tip member 120 is preferably formed of a resilient material like a dense rubber, for example, to provide a suitable combination of both traction and durability. It is preferably formed to define a head portion 122 having a sloped surface 1220 converging to a rounded point 1222. A plurality of spaced annular ribs 1224 are protrusively formed on this sloped surface 1220. During use, the rounded point 1222 serves as a pivoting or rocking point about which the tip member 120 may be easily rocked, tilted, or rotated. When sufficiently tilted, one or more of the annual ribs 1224 enhance gripping action upon the underlying support surface.

Each tip member 120 preferably also includes a neck portion 124 which extends axially downward from the head portion 122. The neck portion 124 is preferably of a substantially cylindrical contour dimensioned for frictional coaxial insert into the openings defined by each support member end portion 114*a*, 114*b*. The base of the head portion 122 then forms an overhanging rim 123 which serves to stoppingly engage the end face of the given end portion 114*a*, 114*b*. This is but one example of numerous other constructions for the tip member 120, and the means by which it is provided at an end portion 114*a*, 114*b*. Each tip member 120 may be formed with various other shapes, and from various other materials, depending on their suitability for the intended application. In certain embodiments, for example, a tip member 20 may be coupled by additional fastening measures not shown. In certain other embodiments, the tip member may simply be formed as an integral extension of the support member 110, with perhaps a high friction coating or attachment, a roughened bottom, or other suitable measure provided thereon for enhanced traction.

Figure 10:
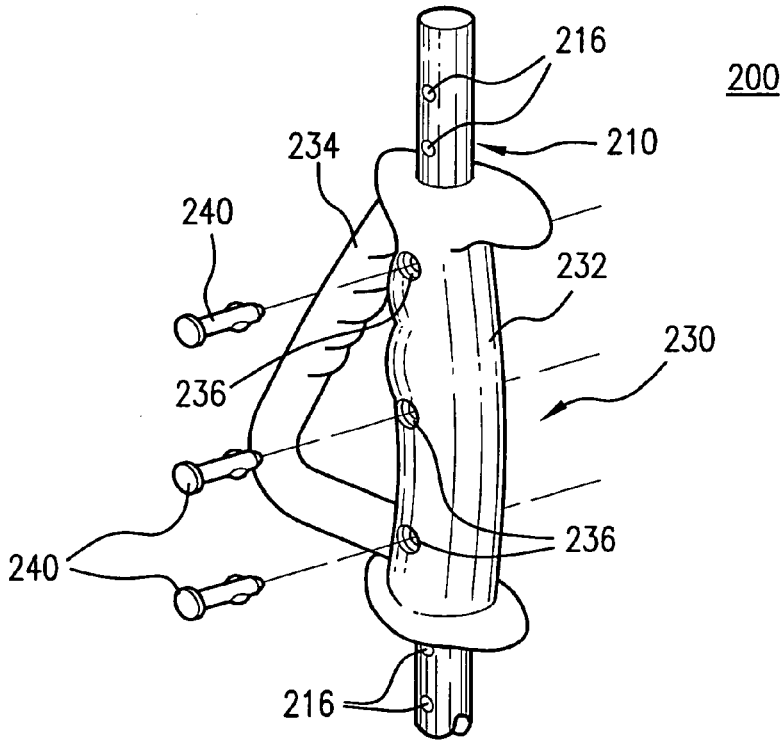

Referring now to FIG. 10, there is shown still another embodiment of the present invention adapted for ski or trekking pole-type applications. In this embodiment, the main body portion 232 of the grip handle member 230 is preferably configured with an undulating contour to accommodate the user's hand and serve as an alternate gripping point apart from that provided by the angled grip portion 234. Similar to conventional uses, a user may grip the main body portion 232 itself to manipulate the apparatus 200. During use in this manner, the angled grip portion 234 serves effectively as a hand/finger guard. The user may revert back to a more ergonomic use of the apparatus 200 by rotating the apparatus 200 and regripping instead the angled grip portion 234 as in the preceding embodiment.

The positioning openings 216 in this embodiment are preferably arranged closer to the upper end of the support member 210 than in the embodiment illustrated in FIGS. 7-8. Still, the grip handle member 230 may be adjusted to any one of numerous positions relative to the support member 210, much as in the preceding embodiment. The main body portion 232 is, therefore, formed with a plurality of access openings 236 formed transversely therethrough. Because the main body portion 232 itself serves as an alternate gripping point, however, the fastener members 240 are configured (as are their receiving access openings 236) such that they remain substantially recessed within the access openings 236. This prevents the fastener members 240 from obstructing/interrupting the main body portion's gripping surface. The access openings 236 are for this reason suitably configured—with flanged regions, for instance—to provide sufficient recessed clearance when accommodating a given fastener member 240.

As in the embodiment of FIGS. 7-8, the grip handle member 230 may be formed of any suitable material known in the art which provides sufficient comfort and gripablility for the user while maintaining the strength, rigidity, and durability required for the intended application. Preferably, the grip handle member 230, 130 in each of these embodiments is integrally formed of a resilient material such as a suitable urethane foam, plastic, rubber, or other material of comparable properties, depending on the particularities of the given embodiment and intended application. In one exemplary embodiment, a urethane foam of approximately 70 point durometer hardness is found to offer a desirable combination of comfort and utility. Though the present invention is not limited to any particular choice of materials for the various members, factors such as the frictional coupling properties of a given material in relation to the material composition of the support member 110, 210, for instance, may render certain materials more suitable than others.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular features may be reversed or interposed, all without departing from the spirit or scope of the invention as defined in the appended claims.

What is claimed is:

1. An ergonomic support staff apparatus for supporting a user upon a surface comprising:

a substantially linear longitudinally extended support member having a plurality of positioning holes formed transversely therein;

a grip handle member adjustably coupled to said support member, said grip handle member including:

a substantially tubular main body portion coaxially ensleeving a portion of said support member, said main body portion having a plurality of access openings formed transversely therethrough for selective alignment with respective ones of said support member positioning holes;

an angled grip portion protruding laterally outward from said main body portion, said angled grip portion extending longitudinally downward along said main body portion in obliquely inclined manner relative to said support member;

an arm portion extending transversely from said angled grip portion to said main body portion; and, a plurality of fastener members engaging aligned pairs of said access openings and said positioning holes to releasably lock said grip handle member to said support member;

whereby the range of requisite arm swing motion for manipulation of said support member into stable engagement of the surface is minimized.

2. The ergonomic support staff apparatus as recited in claim 1 wherein said support member includes longitudinally opposed first and second ends, at least said first end terminating at a substantially conical tip member.

3. The ergonomic support staff apparatus as recited in claim 2 wherein said tip member is detachable from said first end, said tip member defining a head portion having a sloped surface converging to a rounded point, and a plurality of spaced annular ribs formed on said sloped surface.

4. The ergonomic support staff apparatus as recited in claim 3 comprising a plurality of said tip members detachably coupled to said first and second ends of said support member respectively.

5. The ergonomic support staff apparatus as recited in claim 4 wherein each said tip member includes a neck portion extending axially from said head portion, said neck portion being inserted into one of said first and second ends for frictional engagement therewith.

6. The ergonomic support staff apparatus as recited in claim 5 wherein each said tip member is formed of a rubber material.

7. The ergonomic support staff apparatus as recited in claim 1 wherein said support member includes first and second sets of said positioning holes respectively disposed adjacent upper and lower ends of said support member for selective securement of said grip member thereto.

8. The ergonomic support staff apparatus as recited in claim 1 wherein said grip handle member is integrally formed of a resilient material.

9. The ergonomic support staff apparatus as recited in claim 8 wherein said grip handle member is formed of a urethane foam material.

10. The ergonomic support staff apparatus as recited in claim 1 wherein said angled grip portion of said grip handle member includes a plurality of grip enhancing grooves formed therein.

11. The ergonomic support staff apparatus as recited in claim 1 wherein said main body portion of said grip handle member is formed with an undulating contour to define an alternate gripping point offset from said grip portion.

12. The ergonomic support staff apparatus as recited in claim 11 wherein said lower portion of said support member terminates at a pointed ski pole tip.

13. The ergonomic support staff apparatus as recited in claim 1 wherein at least one of said fastener members includes a pin having a resiliently biased retention element for retentively engaging at least one of said support and grip handle members.

14. The ergonomic support staff apparatus as recited in claim 1 wherein said support member is formed from a material selected from the group consisting of: metal, plastic, wood, and composite.

15. The ergonomic support staff apparatus as recited in claim 1 further comprising a tack enhancing layer formed about at least a portion of said support member adjacent said grip handle member.

16. An ergonomic support rod apparatus for supplemental support of a user upon a surface comprising:

a substantially linear longitudinally extended support member having upper and lower portions and an intermediate shaft portion extending therebetween, said intermediate shaft portion having a plurality of through holes formed transversely therein;

a grip handle member adjustably coupled to said support member, said grip handle member including:

a main body portion slidably coupled to at least one of said support member portion, said main body portion having a plurality of access openings formed transversely therethrough for selective alignment with respective ones of said support member through holes;

an angled grip portion protruding laterally outward from said main body portion, said angled grip portion extending longitudinally downward along said main body portion in obliquely inclined manner relative to said support member;

an arm portion extending transversely from said angled grip portion to said main body portion;

a plurality of fastener members engaging aligned pairs of said access openings and said through holes to releasably lock said grip handle member to said support member; and, a substantially conical tip member detachably coupled to at least said lower end, said tip member defining a head portion having a sloped surface converging to a rounded point, and a plurality of spaced annular ribs formed on said sloped surface;

whereby the range of requisite arm swing motion for manipulation of said support member into stable engagement of the surface is minimized.

17. The ergonomic support rod apparatus as recited in claim 16 wherein said support member includes first and second sets of said through holes respectively disposed adjacent said upper and lower end portions of said support member for selective securement of said grip member thereto.

18. The ergonomic support rod apparatus as recited in claim 17 wherein said main body portion of said grip handle member is formed with an undulating contour to define an alternate gripping point offset from said grip portion.

19. An ergonomic support staff apparatus for supporting a user upon a surface comprising:

a substantially linear longitudinally extended support member having a plurality of through holes formed transversely therein;

a grip handle member adjustably coupled to said support member, said grip handle member being integrally formed of a resilient material to include:

a main body portion coaxially ensleeving a portion of said support member, said main body portion having a plurality of access openings formed transversely therethrough for selective alignment with respective ones of said support member through holes; and, an angled grip portion protruding laterally outward from said main body portion, said angled grip portion extending longitudinally downward along said main body portion in obliquely inclined manner relative to said support member, said angled grip portion being angularly offset from said support member by a relative angle substantially within the approximate range of 33°-45°;

an arm portion extending transversely from said angled grip portion to said main body portion; and, a plurality of fastener members engaging aligned pairs of said access openings and said through holes to releasably lock said grip handle member to said support member;

whereby the range of requisite arm swing motion for manipulation of said support member into stable engagement of the surface is minimized.

20. The ergonomic support staff apparatus as recited in claim 19 wherein support member is substantially tubular in contour and terminates at longitudinally opposed upper and lower ends; a plurality of substantially conical tip members being detachably coupled to at least said upper and lower ends respectively, each said tip member being formed of a resilient material to define a head portion having a sloped surface converging to a rounded point, and a plurality of spaced annular ribs formed on said sloped surface.

* * * * *